United States Patent [19]

Hope et al.

[11] Patent Number: 5,057,651

[45] Date of Patent: Oct. 15, 1991

[54] LIGHTWEIGHT ELECTROCONDUCTIVE WIRE

[76] Inventors: Henry F. Hope; Stephen F. Hope, both c/o Hope Industries, Inc., Willow Grove, Pa. 19090

[21] Appl. No.: 498,725

[22] Filed: Mar. 26, 1990

[51] Int. Cl.[5] ..... H01B 7/00

[52] U.S. Cl. ..... 174/107; 174/117 F; 174/DIG. 7

[58] Field of Search ..... 174/DIG. 7, 107, 117 R, 174/117 F, 117 FF

[56] References Cited

U.S. PATENT DOCUMENTS

| | | | |
|---|---|---|---|
| 1,915,788 | 6/1933 | Hardy | 174/DIG. 7 X |
| 3,333,049 | 7/1967 | Humphrey et al. | 174/DIG. 7 X |
| 3,346,690 | 10/1967 | McNerney | 174/DIG. 7 X |
| 3,370,344 | 2/1968 | Feick, III | 174/DIG. 7 X |
| 3,389,460 | 6/1968 | Rubinstein et al. | 174/DIG. 7 X |
| 3,649,745 | 3/1972 | Volk | 174/107 |
| 4,107,142 | 8/1978 | Cunliffe et al. | 525/529 X |
| 4,331,793 | 5/1982 | Emmons et al. | 525/383 X |

*Primary Examiner*—Morris H. Nimmo

*Attorney, Agent, or Firm*—Z. T. Wobensmith, III

[57] ABSTRACT

Lightweight electroconductive wire which includes a strip of lithium metal with copper connectors at each end, and encapsulated within a layer of moisture proof aluminum foil, which has an anhydrous glue coating with an outer encapsulating layer of insulating plastic tape that has a coating of adhesive retaining it on the foil. The copper contacts extend outside the layer of tape and are plated with metal that is non reactive with lithium at contact with the lithium.

6 Claims, 1 Drawing Sheet

LIGHTWEIGHT ELECTROCONDUCTIVE WIRE

BACKGROUND OF THE INVENTION

1. Field of the Invention

This invention relates to a lightweight electroconductive wire of the type which has a core of insulated encapsulated electroconductive material with exposed contacts at each end.

2. Description of the Prior Art

Lightweight electroconductive wire is much in demand for certain applications. In space vehicles, where every fraction of an ounce counts, the elimination of weight is a priority item, decreasing cost of payload by thousands of dollars for each pound of weight reduction.

Lightweight wires must have good electrical conductivity characteristics, be easy to hook up and replace, be relatively easy to manufacture and have high durability.

No previous structure has solved the weight and electroconductivity problems which the lightweight wire of the invention overcomes.

SUMMARY OF THE INVENTION

It has now been found that a lightweight wire which includes a core or wire of lithium metal, encapsulated in a layer of anyhydrous adhesive coated aluminum foil which provides a moisture barrier, which has an outer layer of insulating plastic tape also coated with anhydrous adhesive, which layers can be interchanged, and with copper terminals at each end, plated with metal that is non-reactive with lithium such as gold at lithium contact, provides a lightweight wire which has durability, versatility and excellent electrical conductivity characteristics.

The principal object of the invention is to provide a lightweight wire which has excellent electroconductivity characteristics.

A further object of the invention is to provide a lightweight wire that has a multiplicity of applications.

A further object of the invention is to provide a lightweight wire that is simple and inexpensive to manufacture, but durable and of long service life.

A further object of the invention is to provide a lightweight wire that is of reduced weight.

A further object of the invention is to provide a lightweight wire that is moistureproof, and electrically insulated.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
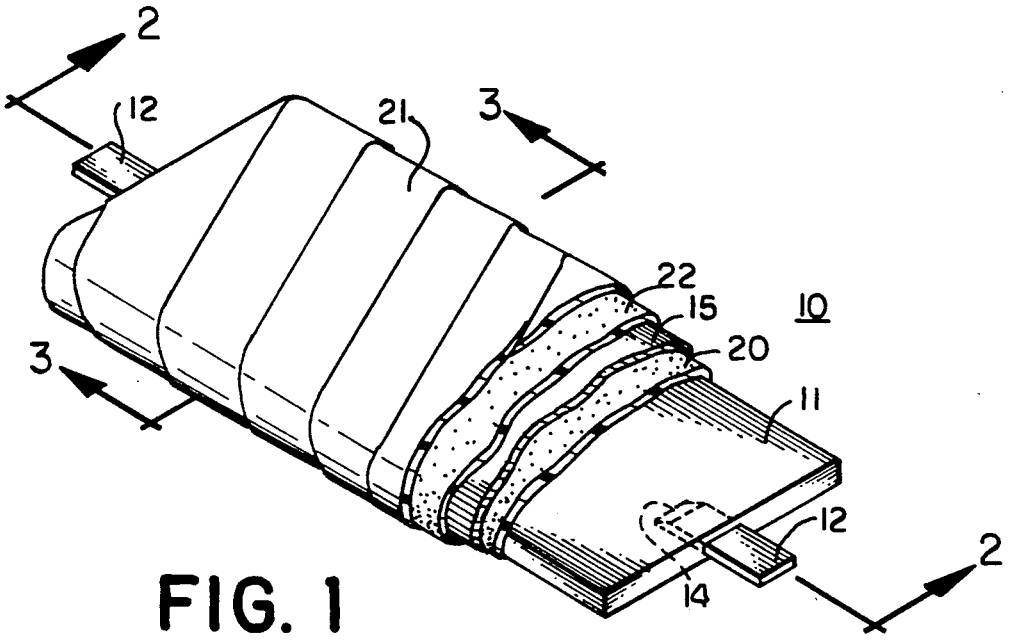
FIG. 1 is a view in perspective, partly broken away illustrating the wire of the invention.
Figure 2:
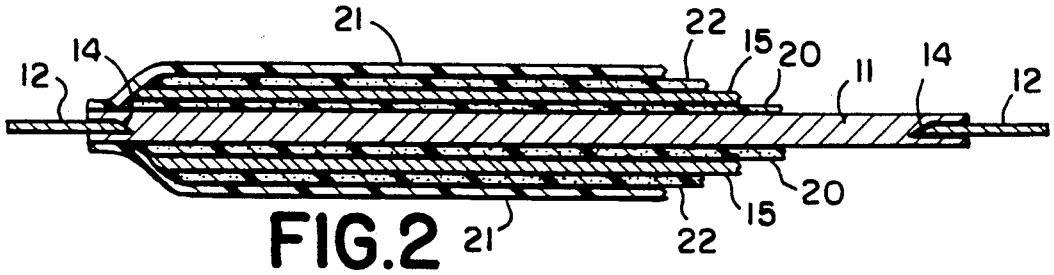
FIG. 2 is a vertical sectional view, enlarged, taken approximately on the lines 2—2 of FIG. 1.
Figure 3:
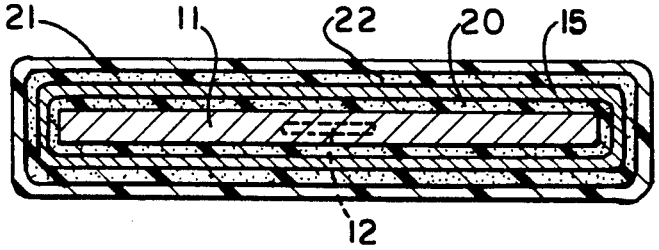
FIG. 3 is a vertical sectional view, enlarged, taken approximately on the line 3—3 of FIG. 1.

It should, of course, be understood that the description and drawings herein are illustrative merely, and that various modifications and changes can be made in the structure disclosed without departing from the spirit of the invention.

DESCRIPTION OF THE PREFERRED EMBODIMENT

Referring now more particularly to the drawings, a lightweight wire 10 constructed in accordance with the invention is therein illustrated. The wire 10 includes a core 11 which as illustrated is of lithium metal. The core 11 which can be of a suitable cross section, and of any desired length, has a pair of copper terminals 12 at each end, which terminals are of well known type, and can be of any desired configuration consistent with the rest of the structure and attached to the core by pressure bonding. The terminals 12 must be plated with metal that is non-reactive with lithium, and that also possesses good electrical conductivity at points 14 where they contact the lithium core 11, for improved electrical conductivity, and gold has proven to be a preferred material. The lithium core 11 as illustrated is of flat ribbon-like configuration which has been found to be quite satisfactory for fabrication. The core 11 is encapsulated in a layer 15 of aluminum foil, which has been coated with an epoxide based acrylic or rubber based anyhydrous adhesive 20 of well known type. The adhesive coating 20 serves to retain the layer 15 on the core 11, and aluminum foil moisture proofs the lithium core 11, which would otherwise be subject to deterioration from moisture. Construction of the wire 10 should take place in a moisture free inert gas atmosphere, in order to avoid contamination and deterioration of the lithium metal. The foil layer 15 has an outer layer 21 of insulating plastic tape thereon of greater length than the foil, of well known type which layer 21 has been coated with adhesive 22, which may be similar to adhesive coating 20.

The terminals 12 at each end of the wire 10 extend beyond the layer 21 for engagement (not shown) as desired.

It will thus be seen that a lightweight wire has been described which achieves the objects of the invention.

We claim:

1. A lightweight wire which comprises
a core of lithium metal,
terminals secured to the ends of said core,
a first anhydrous adhesive coating in adhesive contact with said core,
a layer of moisture proof aluminum foil surrounding said core in adhesive contact with said adhesive,
a second anhydrous adhesive coating on said foil in adhesive contact therewith, and
a layer of insulating plastic surrounding said foil and in adhesive contact with said second layer of adhesive.

2. A lightweight wire as defined in claim 1 in which said terminals are of electroconductive metal, and said terminals are plated at the ends with a non-reactive metal, in contact with said core.

3. A lightweight wire as defined in claim 1 in which said adhesive coating on said foil and said plastic is an acrylic based anhydrous composition.

4. A lightweight wire as defined in claim 1 in which said adhesive coating on said foil is a rubber based anhydrous composition.

5. A lightweight wire as defined in claim 2 in which said terminals are of copper, and said plating is of gold metal.

6. A lightweight wire as defined in claim 1 in which said adhesive coating on said foil in an epoxide based composition.

* * * * *

UNITED STATES PATENT AND TRADEMARK OFFICE

CERTIFICATE OF CORRECTION

PATENT NO. : 5,057,651

DATED : October 15, 1991

INVENTOR(S) : Henry F. Hope and Stephen F. Hope

It is certified that error appears in the above-identified patent and that said Letters Patent is hereby corrected as shown below:

Column 2

Line 66, "in" should be - is - .

Signed and Sealed this

Nineteenth Day of January, 1993

*Attest:*

*Attesting Officer*

DOUGLAS B. COMER

*Acting Commissioner of Patents and Trademarks*